United States Patent [19]

Turner

[11] 3,943,479

[45] Mar. 9, 1976

[54] ENERGY REGULATOR

[75] Inventor: Norman Jack Turner, Tauranga, New Zealand

[73] Assignee: Australian Controls Industries Pty., Ltd., Niddrie, Australia

[22] Filed: July 24, 1974

[21] Appl. No.: 491,284

[52] U.S. Cl. ..... 337/347; 337/349; 337/360; 337/361

[51] Int. Cl.[2] ..... H01H 37/12; H01H 37/14

[58] Field of Search ..... 337/27, 102, 103, 104, 337/105, 333, 347, 349, 360, 361, 368, 372, 374, 377, 380, 107

[56] References Cited

UNITED STATES PATENTS

| | | | |
|---|---|---|---|
| 3,109,717 | 11/1963 | Clapp | 337/102 X |
| 3,466,587 | 9/1969 | Rechou et al. | 337/347 |

*Primary Examiner*—J. D. Miller
*Assistant Examiner*—Fred E. Bell
*Attorney, Agent, or Firm*—Graybeal, Barnard, Uhlir & Hughes

[57] ABSTRACT

A thermally actuated energy regulator of the kind including a switch controlled through a heat responsive actuator in the form of a bi-metal assembly. A lever is arranged to act between the actuator and the switch so as to actuate a switch in response to pressure applied to the lever by deflection of the actuator, which deflection occurs when the heater associated with the actuator is energized. The lever reacts against a fulcrum, the position of which is adjustable through a cam, and that adjustment permits variation of the amount of deflection of the actuator necessary to cause operation of the switch through the interacting lever. The switch, actuator and cam are secured to a body section in fixed relationship so that calibration of the regulator is simplified.

16 Claims, 6 Drawing Figures

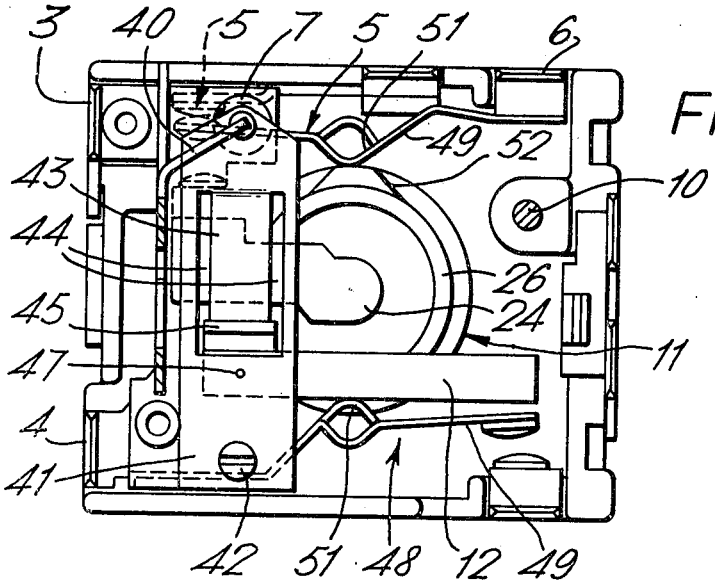
Fig.3.
Fig.4.
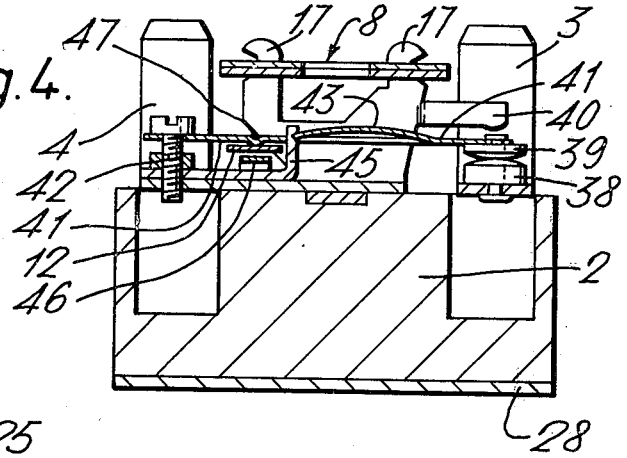
Fig.5.
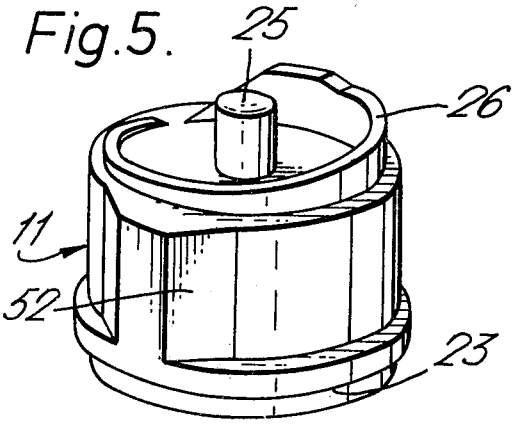
Fig.6.
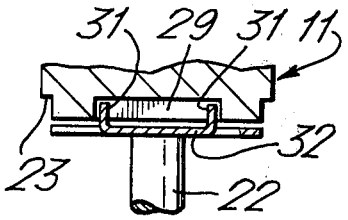

ENERGY REGULATOR

This invention relates to thermally actuated energy regulators of the kind used in electric circuitry. Such regulators are commonly used for controlling the rate of energization of heating devices or units such as the heating elements of an electric range, and it will be convenient to hereinafter describe the invention in relation to that example application.

Thermally controlled energy regulators have been known and used for many years. Generally, such regulators include a bi-metal actuator in the form of a strip or arm which flexes or bends in response to changes in temperature of an associated heater device, and is operatively connected to a switch so as to control opening and closing of the contacts in accordance with heat output of the associated heating device. Such regulators, also sometimes referred to as infinite switches or simmer controls, provide a means for controlling the amount of electrical energy supplied to a load, usually a heating element such as a hotplate on an electric cooker, over a desired range. That control is achieved, at all settings over the range concerned, by intermittently opening the switch and thereby interrupting the supply of electric energy to the hotplate. Selection of a particular setting is effected through adjustable means such as a cam which determines the amount of work the bi-metal actuator must perform to open the switch contacts.

For effective operation, the regulator must of course be calibrated so that each setting of the cam, as indicated by a control knob and/or scale, results in a particular and known energy supply to the associated heating element. It is found however, that accurate calibration is extremely difficult with the constructions proposed prior to this invention, and it is also difficult to achieve a stable calibration so that the results produced by the regulator are consistent during its useful life. One reason for both difficulties is that the relative positions of some of the critical components, such as a cam, bi-metal, and movable switch element, are not fixed until the regulator is actually mounted in position ready for use — e.g. connected to a control spindle. With such an arrangement, calibration can not be effected until the regulator is mounted ready for use, and subsequent disturbance of that mounting can upset the calibration.

Another reason for calibration difficulties in some prior constructions, is that adjustment of the cam (i.e. adjustment of the energy setting) results in bodily movement of either the switch or the bi-metal. The need to allow for such movement necessarily introduces instability into the construction with consequent adverse affects on calibration accuracy and reliability.

Another problem is that of miniaturization which is becoming increasingly important because of the general demand for compact apparatus and mechanisms generally. The inability of manufacturers to miniaturize energy regulators of the kind in question, has retarded the development of related apparatus and mechanisms such as to fully satisfy present day requirements.

It is a principal object of the present invention to provide a regulator which is able to be calibrated prior to attachment into a particular work situation, and which is relatively stable so as to maintain that calibration during use. A further object of the invention in a preferred form, is to provide such a regulator which is of compact construction. Other objects and advantages will be apparent from the following detailed description of one particular form of the regulator.

According to one aspect of the present invention, there is provided an electrical energy regulator including; a body section; an actuator attached to said body section and having a heater associated therewith, part of said actuator being movable relative to the remainder thereof in response to energization of said heater; switch means secured to said body section in predetermined relation to said actuator; lever means acting between said actuator and said switch means and being movable about a fulcrum in response to said movement of the actuator and to thereby cause actuation of said switch means; and cam means movably mounted on said body section and being operable to adjust the position of said fulcrum relative to said actuator and to thereby alter the amount of movement of said actuator part necessary to cause actuation of said switch means.

According to another aspect, there is provided an electrical energy regulator including a body section; an actuator attached to said body section and having a heater associated therewith, part of said actuator tending to deflect therewith, part of said actuator tending to deflect in response to energization of said heater; switch means secured to said body section in predetermined relation to said actuator; lever means acting between said actuator and said switch means and being responsive to pressure applied thereto by deflection of said actuator part to cause actuation of said switch means; said lever means reacting against a fulcrum when said pressure is applied thereto; and cam means movably mounted on said body section and being operable to adjust the position of said fulcrum relative to said actuator and to thereby alter the pressure necessary between said actuator and said lever means to cause actuation of said switch means.

The principal features of the invention can be applied to a wide range of basic constructions. It will be convenient however, to describe the invention in relation to one particular construction which is shown in the drawings and is to be regarded as typical and not limiting. Nevertheless, a number of subsidiary features are embodied in that typical construction as will be hereinafter made clear.

The following description refers in more detail to these essential features and further optional features of the invention. To facilitate an understanding of the invention, reference is made to the accompanying drawings where these features are illustrated in preferred form. It is to be understood however, that the essential and optional features of the invention are not limited to the specific forms of these features as shown in the drawings.

In the drawings:

FIG. 3 is a cross sectional view taken along line 3—3 of FIG. 2;

FIG. 4 is a cross sectional view taken along line 4—4 of FIG. 1;

FIG. 5 is a perspective view on an enlarged scale of the cam used in the construction of FIG. 1; and FIG. 6 is a fragmentary sectional view showing the drive connection between the cam and the control spindle of the construction of FIG. 1.

Figure 1:
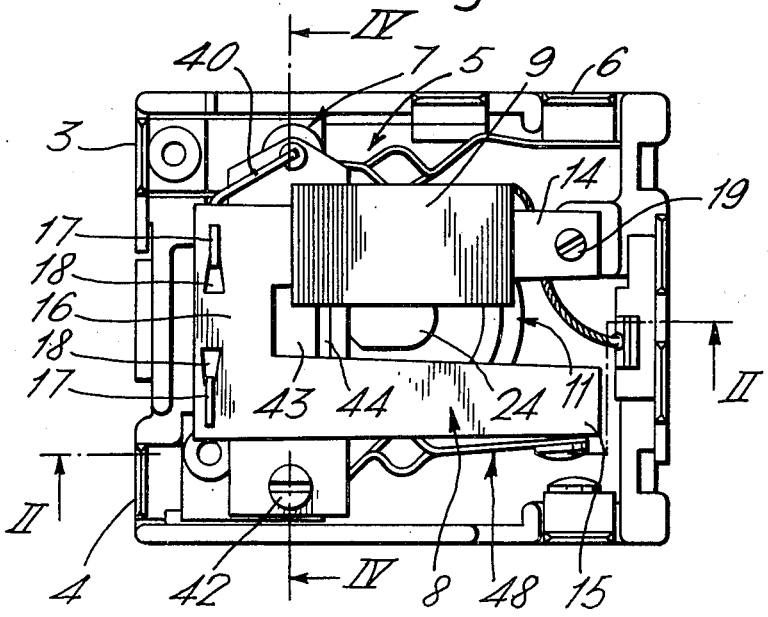
FIG. 1 is a plan view of one particular regulator made in accordance with the invention.

The aforementioned typical construction includes a base member 2 which supports a number of conductor terminals including an active terminal 3 for connection to the mains supply and a load terminal 4 for connection to the device or unit (e.g., heating element) to be energized through the regulator. The base member 2 carries a switch 5 for providing a connection between the active terminal 3 and a pilot terminal 6, and a thermally responsive switch 7 for providing a connection between the active and load terminals 3 and 4. A bi-metal actuator 8 having a heater 9 associated therewith is also carried by the base member 2, as is adjusting means in the form of a rotatable cam 11 which is arranged to control both the switch 5 and the thermally responsive switch 7.

In the form shown, the base member 2 comprises a substantially rectangular block of electrically nonconductive material having one of the broader faces recessed to contain or mount various components of the regulator. In practice, the recessed face is usually the rear face of the base member the regulator is when mounted in an operative position, but will be identified as the outer face for convenience of description.

It is a feature of the particular construction shown, that the bi-metal actuator 8, switch 7, and cam 11, occupy fixed relative locations on the base section 2 and are attached to that section so that they cannot move from such locations. The actual distances between those components then remains constant but their effective relationships which govern the operative setting of the regulator are adjustable by means interacting between them. That means includes a lever 12 through which movement of the bi-metal actuator 8 is translated to the switch 7, and a fulcrum 13 which influences the lever 12 and the position of which can be adjusted by rotation of the cam 11. If desired the fulcrum and lever could be formed by a single component, and/or a plurality of levers may be in the actuator to switch connection.

If the preferred embodiment shown, the bi-metal actuator 8 consists of a substantially U-shaped piece of thermostatic bi-metal having two laterally spaced arms 14 and 15 joined at one end by a bridge portion 16. The element of the heater 9 is wound around the arm 14, and the terminal end portion of that arm is attached to the base section 2 through a calibrating or adjusting screw 10. The primary mounting of the actuator however, is effected by attachment of bridge portion 16 to two support members 17 upstanding from and secured to the base section 2. Each member 17 is notched near its terminal end and snap engages within a suitably shaped aperature 18 in the bridge portion 16 so as to retain the actuator 8 positively in position, but in a manner such as to allow the actuator to flex when heated.

Figure 2:
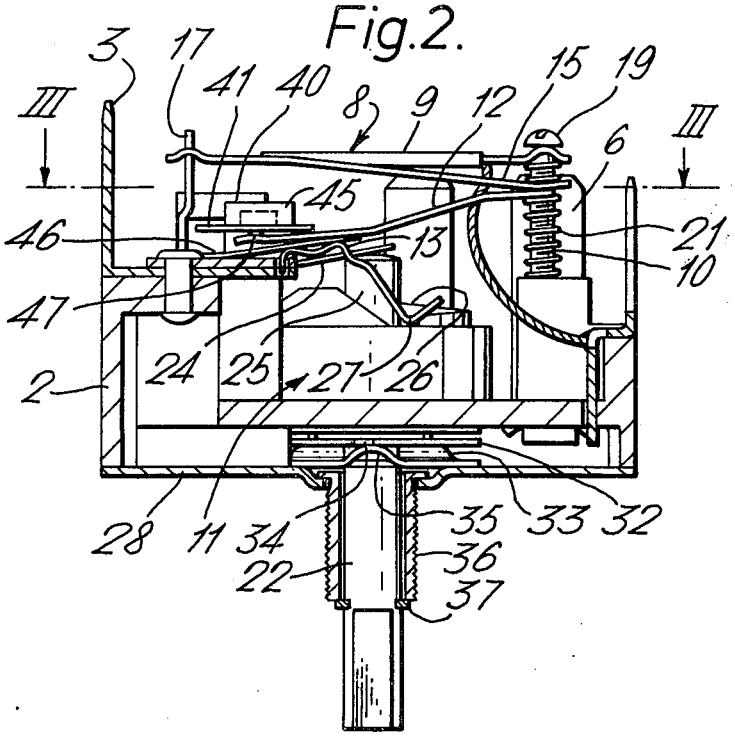
FIG. 2 is a cross sectional view taken along line 2—2 of FIG. 1.

The calibrating screw engages with a screw threaded hole formed in the moulded base 2, or a member secured to that base, and protrudes through a hole in the end of the arm 14 so that the screw head 19 engages the upper or outer surface of the arm 14. A coil spring 21 forces the end of the arm 14 against the underside of the screw head 19 as seen in FIG. 2. Such calibrating means is positive, economical, and not subject to drift throughout the life of the regulator. Since the bi-metal actuator 8 does not pivot, its position relative to other components does not change, therefore less space is required to accommodate it and a consequent reduction in the size of the regulator can be effected.

The cam 11 is formed as a separate component from a rotatable control spindle 22 (FIGS. 2 and 6) through which the cam position is adjusted. Preferably, the cam 11 is of moulded plastic material and is rotatably located in a circular cavity in the base 2 so as to be restrained against undue lateral movement. A shoulder 23 formed around the periphery of the cam 11 provides a bearing surface which bears against an opposed surface of the base 2, and in the construction shown the cam 11 is maintained in that position by a pressure spring 24 bearing on a central projection 25 at the outer side of the cam 11. A cam track 26 is defined at the outer side of the cam by a face extending transverse to the rotational axis, as best seen in FIG. 5. The track 26 is contoured to suit particular requirements, and influences the position of the fulcrum 13 through a cam follower 27, which is shown as formed integral with the fulcrum 13, but that is not essential.

Adjustment of the rotational position of the cam 11 is effected through the control spindle 22 which, in the construction shown, is rotatably supported by a mounting plate 28. The plate 28 is releasably attached to the inner or under side of the base 2, preferably through snap engageable means (not shown), and that plate may remain attached (together with the spindle 22) to a support such as an appliance control panel, independent of the regulator body as comprised by the base 2 and attached components such as the cam 11, switch 7 and actuator 8. Consequently, the calibration of the actuator is not disturbed in any way by connection of the regulator to the control spindle 22, or separation therefrom.

The actual drive connection between the cam 11 and spindle 22 can take any appropriate form, but as a matter of preference should be automatically releasable upon separation of the base 2 and plate 28. One such connection is shown in FIG. 6 and comprises a transverse slot 29 formed in an end face of the cam 11, and cooperable lugs 31 upstanding from a drive plate 32 and locatable in the slot 29. The drive plate 32 is secured to the spindle 22 for rotation therewith, and a knob (not shown) may be secured to the spindle 22 to facilitate rotation thereof.

A disc-like spring 33 may be interposed between the plates 32 and 28, as shown in FIG. 2, so as to provide frictional resistance to turning movement of the spindle 22 and also resist axial movement thereof. At least one, but preferably two or more, recesses 34 as shown in FIG. 2 may be formed in the periphery of the plate 32 for releasable snap engagement with a raised section 35 of the spring 33, and thereby provide indexing means. Such indexing may occur only at each end of the adjustment range spindle 22. The threaded sleeve 36 shown in FIG. 2 is attached to the plate 28 and is provided in the particular constructin shown to permit attachment of the plate 28 to a support. A circlip 37 is used to retain the spindle 22 in assembly with the plate 28.

Turning now to the switch 7, that includes a fixed contact 38 connected to the terminal 3 through a conductive path, and a movable contact 39 carried at one end portion of a spring blade 41. The other end of the blade 41 is secured to the base 2 as at 42 shown in FIGS. 1 and 4. A member 40 is preferably arranged as shown to limit upward travel of the end of the blade 41 which carries the contact 39.

A feature of the particular spring blade 41 shown in the drawings, is that a center section 43 is partially separated from the main body, and that partial separation is effected by two slots or cuts 44 (see FIG. 3) formed through the blade 41 and which extend generally in the longitudinal direction of the blade 41 in laterally spaced relationship. The slots 44 form the lateral boundaries of the center or finger section 43, and one end of that section is integral with the main body of the blade 41. The other or free end of the finger section 43 engages within a groove or recess of a reaction plate 45 secured to the base 2, and the arrangement is such that finger section 43 is prestressed as shown in FIG. 4. That prestressing normally acts to force the contact 39 into engagement with the fixed contact 38.

The switch 7 and bi-metal actuator 8 are operatively connected to the lever 12, which simply abuts the outer end portion of the actuator arm 15, but is attached to the base 2, preferably through a leaf spring 46 as shown in FIGS. 2 and 4. The end portion of the lever 12 adjacent to the switch 7 abuts the underside of the blade 41 as also shown in FIGS. 2 and 4. Preferably, that abutment involves substantially point contact, which in the construction shown is achieved through a dome-like or conical projection 47 formed on the underside of the blade 41. Alternatively, a transverse rib may be provided on the blade so as to achieve line contact, or the point projection or rib may be provided on the lever instead. Point or line contact between the lever 12 and blade 41 is desirable because it ensures that the lever pressure applied to the blade 41 is applied at substantially the same point or zone at all times.

In the construction shown in the drawings, the cam 11 is shown as controlling two other switches 5 and 48 which are located on respective sides of the cam 11, but the invention is also applicable to regulators not including such side switches. Each switch 5 and 48 includes a contact blade 49 having a lateral projection 51 which functions as a cam follower and cooperates with a lobe 52 of a cam profile formed on the side surface of the cam 11.

The heater 9 is preferably formed of a winding carried by a former which can be readily attached to the actuator arm 14. By way of example, the former may be a sleeve-like member so as to be slidable over the arm 14 during assembly of the regulator.

When the regulator is connected into a circuit and is switched into an "on" position so that current flows to the heater 9, resulting energisation of the heater causes the actuator 8 to distort, particularly because of its bi-metal construction. In view of the retention of the actuator arm 14 at both ends, the distortion occurs as bowing, but in the arrangement shown that bowing is in a downward direction toward the cam 11, and causes downward movement of the arm 15 through the rigid connection provided by the bridge section 16. That movement of the arm 15 causes the lever 12 to swing about the fulcrum 13 so that the end engaging the spring blade 41 moves upwardly, as does the blade itself, or at least the part thereof engaged by the lever 12. A point is reached at which upward travel of the blade 49 at the zone engaged by the lever 12, overcomes the closing force imparted to the switch 7 by the stressed finger 43, and the blade 41 then functions to snap the switch into the open position.

Opening of the switch also serves to severe the supply of current to the heater 9 so that it then proceeds to cool. As cooling progresses, the arm 15 returns towards its original position, so that the end of the lever 12 engaging the switch blade 41 moves downwardly, and the switch 7 is eventually closed by action of the blade 41.

It will be understood that the arrangement may be such that the actuator arm 15 and/or the lever 12 does not rely on actual movement for the switching operation, or for at least part of that operation. That is, the switch 7 could be actuated, at least initially, by transference of pressure from the arm 15 through the lever 12 to the switch blade 41. As energixed heater 9 causes or tends to cause distortion or deflection of the arm 15, pressure is thereby applied to the lever 12 which reacts with the fulcrum 13 to apply pressure to the switch blade 41. Initially, there may not be any responsive movement of the end of the blade 41 carrying the contact 39, although the increasing pressure may cause some deflection or distortion of any one or more of the components formed by the arm 15, lever 12, and blade 41. At a certain pressure, the upward influence on the blade 41 will be such that the closing influence of the finger 43 will be overcome so that the switch is snapped into the open position. As with the previously described arrangement, the time of opening is determined according to the position of the fulcrum 13.

From the foregoing description it will be seen that the actuator switch and calibrating components of the switch can be combined together as a sub-assembly separate from control means such as a control spindle. In particular, the switch 7, actuator 8, and cam 11 are mounted on a base section 2 in fixed relationship having no dependence on the control to which the sub-assembly is eventually connected. Consequently, the regulator can be calibrated at any time to suit a particular application, and can be stored in the calibrated condition. Eventual connection to a control such as a control spindle does not affect the calibration.

As a mounting plate 28 and attached spindle 22 of the construction particularly described, are attachable as an assembly to a support separate from the aforementioned sub-assembly, that sub-assembly can be attached to and removed from the support and the influence of the control spindle, as desired, again without affecting calibration. The construction is therefore extremely convenient to use and is adaptable to automatic manufacturing and assembly techniques.

The construction described is compact because of the particular arrangement of the various components, and the form of the switch 7 is a significant factor in that regard. The particular spring blade of switch 7 as described, is also useful in that it enables pressure to be maintained substantially constant up to the time of contact break, and is such that the electrical resistance across the switch is at a minimum thereby allowing the use of a small switch spring to achieve the desired control rating. Another related advantage is that the resulting switch is not position or mounting sensitive, particularly as in the normal position of use, the switch action is in a vertical plane rather than in a horizontal plane as in conventional constructions.

Finally, it is to be understood that various alterations, modifications and/or additions may be introduced into the constructions and arrangements of parts previously described without departing from the spirit or ambit of the invention as defined by the appended claims.

Having now described my invention, what I claim as new and desire to secure by Letters Patent is:

1. An electrical energy regulator including; a body section; an actuator attached to said body section and having a heater associated therewith, part of said actuator being movable relative to the remainder thereof in response to energization of said heater; switch means secured to said body section in predetermined relation to said actuator; lever means acting between said actuator and said switch means and being movable about a fulcrum in response to said movement of the actuator and to thereby cause actuation of said switch means; and cam means movably mounted on said body section and being operable to adjust the position of said fulcrum relative to said actuator and to thereby alter the amount of movement of said actuator part necessary to cause actuation of said switch means.

2. A regulator according to claim 1, wherein said actuator comprises a bi-metal member having two laterally spaced arms interconnected by a bridge portion at one end; said bridge portion and the remote end of one said arm being attached to said body section; the other said arm forming said movable part of the actuator, and the said movement thereof results from flexing about said bridge portion attachment.

3. A regulator according to claim 2, wherein said bridge portion is attached to said body section in a fixed position relevant thereto, and the end attachment of said one arm includes adjustable means whereby the position of the said remote end relative to said body section can be varied.

4. A regulator according to claim 3, wherein said adjustable means comprises a calibrating screw.

5. An electrical energy regulator including a body section; an actuator attached to said body section and having a heater associated therewith, part of said actuator tending to deflect in response to energization of said heater; switch means secured to said body section in predetermined relation to said actuator; lever means acting between said actuator and said switch means and being responsive to pressure applied thereto by deflection of said actuator part to cause actuation of said switch means; said lever means reacting against a fulcrum when said pressure is applied thereto; and cam means movably mounted on said body section and being operable to adjust the position of said fulcrum relative to said actuator and to thereby alter the pressure necessary between said actuator and said lever means to cause actuation of said switch means.

6. A regulator according to claim 5, wherein said lever means includes a lever engaging both said actuator part and said switch means at respective opposite end portions thereof, and said fulcrum is located intermediate said end portions.

7. A regulator according to claim 6, wherein said fulcrum is formed separate from said lever and is attached to said body section for relative movement thereto under the influence of said cam means.

8. A regulator according to claim 5, wherein said switch means includes a contact fixed to said body section and a further contact carried by one end portion of a spring member, the other end portion of said spring member being secured to said body section, and said lever means engages said spring member intermediate said end portions so as to influence the relative positions of said contacts.

9. A regulator according to claim 8, wherein said spring member has a finger section partially separated from the body thereof and disposed intermediate the sides and ends thereof, said finger extending in the general direction between said end portions and being stressed to normally urge the movable contact into engagement with the fixed contact, and said actuator being operative through energization of said heater and resulting movement of said lever means, to separate said contacts.

10. A regulator according to claim 8, wherein said lever means engages a projection extending from one face of said spring member so as to achieve substantially point contact between said lever means and said spring member.

11. An electrical energy regulator including a body section; an actuator attached to said body section and having a heater associated therewith, part of said actuator tending to deflect in response to energization of said heater; switch means secured to said body section in predetermined relation to said actuator; lever means acting between said actuator and said switch means and being responsive to pressure applied thereto by deflection of said actuator part to cause actuation of said switch means; said lever means reacting against a fulcrum when said pressure is applied thereto; a cam member rotatably mounted on said body section in a fixed position relative to said actuator; and a cam follower connected to said fulcrum and engaging a cam surface of said cam member, whereby rotation of said cam member is operative to adjust the position of said fulcrum relative to said actuator and to thereby alter the pressure necessary between said actuator and said lever means to cause actuation of said switch means.

12. A regulator according to claim 11 wherein said actuator overlies at least part of said switch means, said fulcrum, and a substantial part of said lever means.

13. A regulator according to claim 12, wherein part of said switch means is interposed between said actuator and said lever means.

14. A regulator according to claim 11, wherein said cam member is secured to said body section so as to be releasably attachable therewith to a support and/or control means.

15. A regulator according to claim 14, wherein a mounting plate carrying a relatively rotatable spindle is releasably secured to said body section, abutment means attached to said spindle for rotation therewith engages with complementary means of said cam member so that rotation of said spindle causes corresponding rotation of said cam member, and said abutment means and said complementary means being automatically disengageable upon separation of said mounting plate from said body section.

16. A regulator according to claim 11, wherein said cam member has a cam profile on a side surface thereof which is operable to influence an auxiliary switch, and said cam surface is defined by an end face of the cam member which extends transverse to the rotational axis thereof.

* * * * *